US006720840B2

(12) United States Patent
Bohnet

(10) Patent No.: US 6,720,840 B2
(45) Date of Patent: Apr. 13, 2004

(54) POLARIZATION ROTATIONER

(75) Inventor: Gerd Bohnet, Hamden, CT (US)

(73) Assignee: Radio Frequency Systems Inc., Meriden, CT (US)

( * ) Notice: Subject to any disclaimer, the term of this patent is extended or adjusted under 35 U.S.C. 154(b) by 0 days.

(21) Appl. No.: 10/218,590

(22) Filed: Aug. 15, 2002

(65) Prior Publication Data

US 2004/0032305 A1 Feb. 19, 2004

(51) Int. Cl.[7] ..... H01P 1/165
(52) U.S. Cl. ..... 333/21 A; 333/248
(58) Field of Search ..... 333/21 A, 110, 333/125, 136, 158, 103, 248; 342/188; 359/281; 385/11; 343/778, 786; 370/203

(56) References Cited

U.S. PATENT DOCUMENTS

| | | | | | |
|---|---|---|---|---|---|
| 3,001,159 | A | | 9/1961 | Hilsinger, Jr. | |
| 3,760,300 | A | | 9/1973 | Leahy | |
| 3,827,051 | A | * | 7/1974 | Foldes | 370/203 |
| 3,906,407 | A | | 9/1975 | Levaillant et al. | |
| 4,595,890 | A | * | 6/1986 | Cloutier | 333/103 |
| 4,734,660 | A | | 3/1988 | Lofgren | |
| RE32,835 | E | | 1/1989 | Howard | |
| 4,821,046 | A | * | 4/1989 | Wilkes | 343/786 |
| 4,831,384 | A | | 5/1989 | Sefton, Jr. | |
| 4,875,027 | A | | 10/1989 | Spinner | |
| 5,061,037 | A | | 10/1991 | Wong et al. | |
| 5,103,237 | A | * | 4/1992 | Weber | 343/786 |
| 5,235,297 | A | | 8/1993 | Tawil | |
| 5,459,441 | A | | 10/1995 | Weber et al. | |
| 5,612,813 | A | | 3/1997 | Damman et al. | |
| 5,619,173 | A | | 4/1997 | King et al. | |
| 6,297,783 | B1 | * | 10/2001 | Back et al. | 343/778 |
| 6,404,298 | B1 | | 6/2002 | Rohr et al. | |

* cited by examiner

*Primary Examiner*—Patrick Wamsley
(74) *Attorney, Agent, or Firm*—Sughrue Mion, PLLC

(57) ABSTRACT

A waveguide structure that has two rotating parts changes the polarization of a radio frequency signal in two steps or one step. The waveguide structure includes input and output waveguides and a polarization rotator. The output waveguide includes two cavities corresponding to two polarizations. The rotator includes cut-away portions of a rectangular shape which are rotated with respect to each other and the first wave guide by predetermined angles. When the second waveguide is rotated from one cavity to another, the rotator is also rotated, thereby changing the polarization of the signals passing through the waveguide. In addition, if the rotator and the second waveguide are interlocked, then the number of steps required to accomplish the polarization change can be reduced to one, because rotation of the second waveguide will cause the rotation of the polarization rotator.

23 Claims, 2 Drawing Sheets

POLARIZATION ROTATIONER

BACKGROUND OF THE INVENTION

The present invention is directed to antennae for use in high frequency communications systems. Specifically, the present invention relates to a polarization rotator for use in high frequency antennae which allows the polarization of signals to be changed as they pass through a waveguide.

DESCRIPTION OF THE PRIOR ART

Waveguide systems including rotator elements for changing the polarization of a radio signal are well known in the art. Typically, a conventional waveguide system such as that disclosed in U.S. Pat. No. 6,404,298 to S. Rohr et al. includes at least 3 separate rotators located between two waveguides. Each individual rotator has a central passage hole with a cross section corresponding to the open cross section of the waveguides. Each rotator is rotated with respect to the adjacent rotators and the waveguides in order to accomplish the polarization change from the first waveguide to the second.

In high frequency communications systems, it is often necessary to change the polarization of an incoming radio signal prior to the processing of the signal. In particular, waveguide systems used in high frequency radio communications systems include at least one input waveguide and one output waveguide with a series of rotator elements between them designed to change the polarization of the signal.

Conventional high frequency antennas required waveguide systems with a number of rotator elements between the input and output waveguide to accomplish the polarization change.

Specifically, to change the polarization by ninety-degrees each rotator element was rotated by a small amount with respect to adjacent rotator elements, so that the cumulative change across all of the rotator elements between the waveguides would be the desired ninety-degree polarization change.

However, introducing a large number of rotators between the waveguides has a number of problems. The interfaces between adjacent rotators have to be as tightly sealed as possible because poor contact between the rotator disks can significantly reduce signal flow, thereby reducing the usefulness and efficiency of the antenna. In addition, the tight linkage between the adjacent rotator elements requires high precision manufacture, installation, and assembly, which greatly increases the labor time and cost.

Furthermore, additional disks enlarge the overall size of the waveguide system of the antenna. Therefore, manufacturers and service providers have tried to keep the number of disks as low as possible to mitigate these problems.

Based on conventional waveguide systems three rotator disks have been the minimum number possible that would allow a polarization change and be cost effective to manufacture and maintain. Having three rotator disks, means that the conventional waveguide system will have four interfaces, one between the first waveguide and a rotator, two interfaces between the middle rotator and the rotators adjacent to it, and another interface between the second waveguide and the rotator adjacent to it. Furthermore, this conventional waveguide system requires multiple steps to accomplish the polarization change.

What is needed is an antenna feed capable of accomplishing the requisite polarization change with a minimum of effort in a minimum number of steps, with the fewest number of interfaces and parts that can be manufactured cost-effectively.

SUMMARY OF THE INVENTION

In view of the foregoing, the present invention provides an integrated antenna feed for sending and receiving high frequency radio signals. In one embodiment, the antenna feed includes a first waveguide having a cavity and a cavity wall and a second waveguide with a first cavity wall and a second cavity wall perpendicular to the first cavity wall. The second waveguide is rotatable around an axis to align either the first cavity wall or the second cavity wall with the cavity wall of the first waveguide. A rotator between the waveguides has a first portion adjacent to the first waveguide and a second portion adjacent to the second waveguide. Each portion has an opening through which radio signals can pass.

The first and second cavities of the second waveguide respectively correspond to first and second polarizations of the antenna, and these polarization are orthogonal to each other.

In an embodiment, the cavity of the first waveguide and the cavity of the second waveguide have a substantially rectangular cross sections, and the width of the second cavity wall of the second waveguide is greater than the width of the first cavity wall of the second waveguide.

In one embodiment, the width and height of the rotator openings at the first and second portions of the rotator are the same. In addition, the opening of the first portion is rotated by an angle gamma with respect to the opening of the second portion. In another embodiment, the thickness of each of the first and second portions of the rotator is equal to half the thickness of the rotator.

In the first configuration corresponding to a first polarization, the rotator is disposed at an acute angle alpha with respect to the cavity of the first waveguide.

In the second configuration corresponding to a second polarization, the second waveguide is rotated such that said second cavity wall is aligned with the cavity wall of the first waveguide, and the rotator is rotated by an acute angle beta with respect to the first waveguide.

The invention is taught below by way of various specific exemplary embodiments explained in detail, and illustrated in the enclosed drawing figures.

BRIEF DESCRIPTION OF THE DRAWINGS

The drawing figures depict, in highly simplified schematic form, embodiments reflecting the principles of the invention. Many items and details that will be readily understood by one familiar with this field have been omitted so as to avoid obscuring the invention. In the drawings.

DETAILED DESCRIPTION.

The invention will now be taught using various exemplary embodiments. Although the embodiments are described in detail, it will be appreciated that the invention is not limited to just these embodiments, but has a scope that is significantly broader. The appended claims should be consulted to determine the true scope of the invention.

Figure 1:
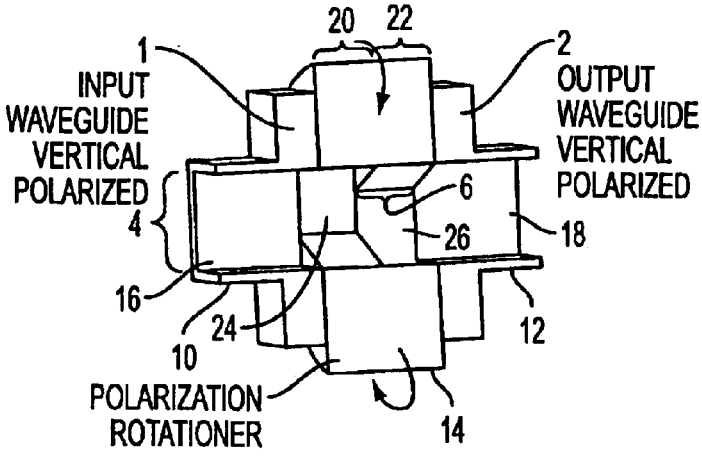
FIG. 1 is a cross-sectional view of the polarization rotator of one embodiment of the present invention, in which the first and second waveguide have a vertical polarization.
Figure 2:
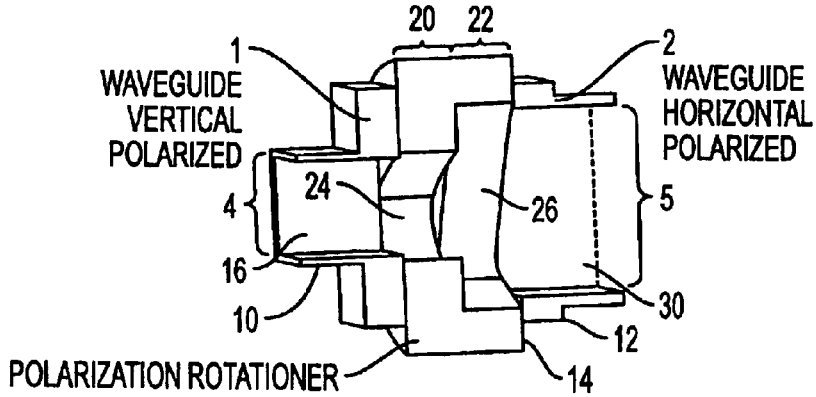
FIG. 2 is a cross-sectional view of the polarization rotator, in which the first waveguide has a vertical polarization and the second waveguide has been rotated to the horizontal polarization position

FIGS. 1 and 2 show cross-sectional views of a practical embodiment of the invention. FIG. 1 shows the first waveguide 10, a second waveguide 12, and the polarization rotator 14 located between them. The first waveguide acts as the input waveguide, while the second waveguide acts as the output waveguide. The second waveguide is rotatable around an axis parallel to the waveguides.

The waveguides and rotator are made of conventional materials, such as die-cast metal or metal coated plastic, and it is envisioned that the present invention can be practiced using any materials commonly used in the construction of conventional antennae, waveguides, and polarization rotators.

FIG. 1 shows both the first and second waveguides in the vertical polarization position. FIG. 2 shows the first waveguide in the vertical polarization and the second waveguide in the horizontal polarization.

First waveguide 10 has a cavity 16 and second waveguide 12 has a first cavity 18 as shown in FIG. 1. Cavities 16 and 18 have a cross-section that is substantially rectangular. The waveguides could be constructed to have rectangular cross sections with right angle corners or rectangular cross sections with rounded corners. Variations on these shapes will occur to one familiar to this field.

The cross sections of cavities 16 and 18 have substantially the same width 4 and are aligned, so that radio waves can pass through the first waveguide 10, through the polarization rotator 14, and through the second waveguide 12 with a minimum of undesired reflection and interference.

The polarization rotator 14 will now be described in more detail. In particular, the polarization rotator 14 is located between the waveguides 10 and 12, and is constructed as a single piece, including a portion 20 adjacent to and facing the first waveguide 10, and a portion 22 adjacent to and facing the second waveguide 12.

These portions 20 and 22 include openings 24 and 26 formed respectively within them. In an embodiment, the openings 24 and 26 have a substantially rectangular cross section with the same length and width and with the centers of the portions aligned in the plane of the rotator. Furthermore, it is preferable that the edges of the openings and the corners of their rectangular cross sections are rounded in order to facilitate the machining of the openings during construction.

The depth 6 of the openings, as measured from the side of the rotator adjacent to a waveguide into the center of the rotator, are preferably equal to each other and to one-half of the thickness of the rotator itself. The present invention is not limited to these specifications, and it is envisioned that one opening of the rotator could have a depth greater than half the depth of the thickness of the rotator, while the other opening could have a depth less than half the thickness of the rotator.

Figure 3:
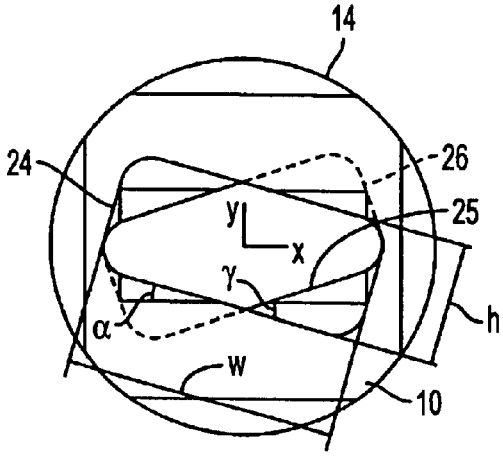
FIG. 3 is a face view of the polarization rotator in a first polarization position.

The openings 24 and 26 in the portions 20 and 22 have the same size and shape, and they are rotated by an angle gamma with respect to each other. In addition, in the orientation shown in FIG. 1 in which both waveguides have a vertical polarization, the rotator is oriented such that the opening 24 in the portion 20 of the rotator 14 is rotated with respect to the cavity 16 of the first waveguide 10 by an angle alpha. FIG. 3 shows the rotation of these openings in detail.

FIG. 3 shows a view of the rotator 14 in the orientation shown in FIG. 1 as viewed from the first waveguide 10 facing the rotator. In particular, while both openings 24 and 26 in the rotator have a substantially rectangular cross section, the passage 25 through the rotator does not have a rectangular shape. This is because the openings 24 and 26 are rotated with respect to each other by an angle gamma and the rotator 14 is rotated such that the first opening 24 is rotated by an angle alpha with respect to the cavity 16 in the first waveguide 10.

In a preferred embodiment, angle gamma is approximately equal to 45 degrees, and angle alpha is equal to −22.5 degrees. Therefore, the second opening 26 of the portion 22 adjacent to the second waveguide is also rotated by an angle of −22.5 degrees with respect to the second waveguide. Thus, because the net effect of all of the rotations is zero degrees, as a signal passes through the first waveguide, across the rotator, and through the second waveguide, its polarization is not changed.

The previous discussion with reference to FIGS. 1 and 3 relates to the orientation of the waveguides and rotator such that both the first and second waveguides were vertically polarized. However, by rotating the second waveguide and the rotator the present embodiment, without any additional or replacement parts, can be oriented so that the first waveguide 10 has a vertical polarization, while the second waveguide 12 has a horizontal polarization. This way, the antenna of the present invention is capable of two orthogonal polarizations.

This orientation of the antenna of the present invention using orthogonally polarized waveguides, is shown in FIG. 2.

FIG. 2 shows the same structures as that of FIG. 1, including first waveguide 10, cavity 16, rotator 14 with portions 20 and 22 and openings 24 and 26. The second waveguide 12 has been rotated ninety degrees with respect to the first waveguide. Cavity wall 30 has a width 5 that is greater than the width 4 of cavity walls 16 and 18, but after the rotation of the second waveguide, cavity wall 30 is now coplanar with cavity wall 16 of the first waveguide.

Figure 4:
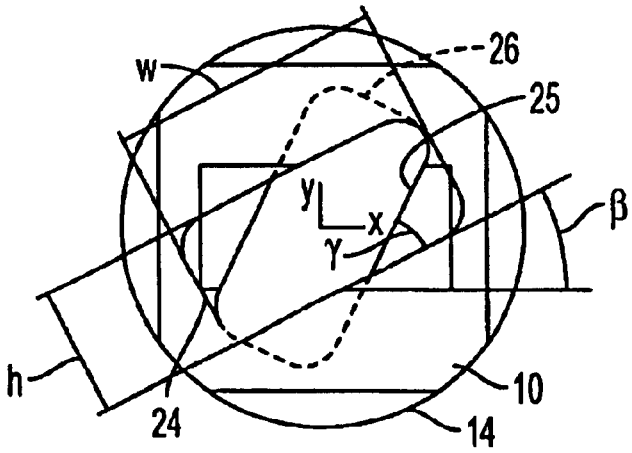
FIG. 4 is a face view of the polarization rotator in a second polarization position

As shown in detail in FIG. 4, when the second waveguide has a polarization orthogonal to that of the first waveguide, the rotator is rotated so that the portion 20 is rotated by an offset angle beta with respect to the cavity wall 16 of the first waveguide. Therefore, when rotating the second waveguide to align the second cavity wall 30 with the cavity wall 16 of the first waveguide, the rotator rotates by an angle of alpha+beta.

Figure 5:
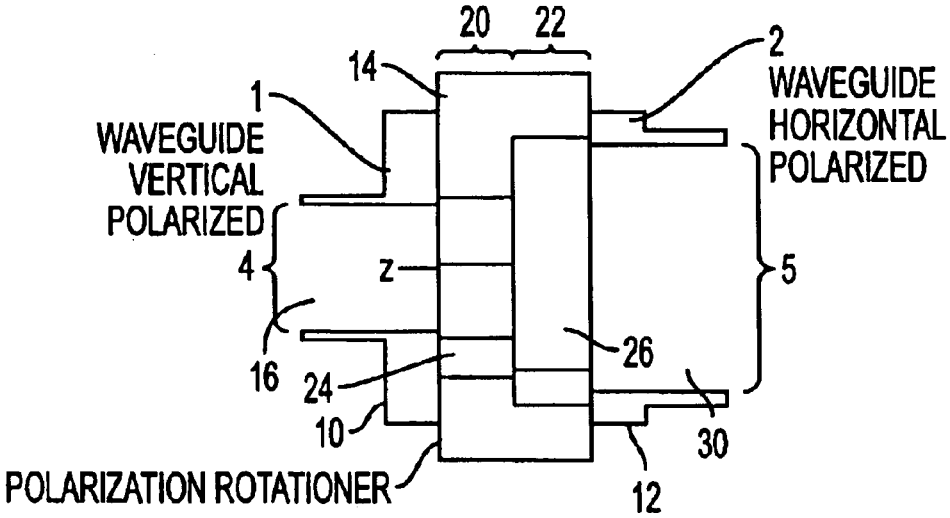
FIG. 5 is a cross-sectional view of the polarization rotator in a second polarization position.

FIG. 5 shows a top-down cross sectional view of the waveguides 10 and 16 and rotator 14. Because of the unique shape of the opening in the rotator, the reflections in the first and second waveguides are the same, and radio waves can transition smoothly from a vertical polarization in the first waveguide to an orthogonal, horizontal polarization in the second waveguide.

In another embodiment, the second waveguide and the rotator are interlocking, so that rotating the second waveguide to align the second cavity wall 30 with the cavity wall 16 of the first waveguide 10 also rotates the rotator by alpha+beta. Thus, the opening 24 in portion 20 is disposed at the offset angle beta to the cavity wall 16 whenever the second waveguide is rotated to the orthogonal orientation. This eliminates the delicate and time-consuming rotation of the rotator members that is required in conjunction with conventional polarization rotators, and reduces the process of changing the polarization to just one step.

In a preferred embodiment, rotating the second waveguide ninety degrees will result in the rotation of the rotator by forty five degrees, so that the cumulative polarization change from the first waveguide, across the rotator, and through the second waveguide is 90 degrees.

By selecting the rotator thickness as given by the depth 6, the length and width of the openings 24 and 26, and the offset angles alpha, beta, and gamma, the antenna can be optimized to have the best voltage standard wave ratio and return loss for both vertical and horizontal polarizations for a given bandwidth over a wide frequency range.

Thus, the principles of the present invention provide an antenna with a polarization rotator, which can be constructed using a minimum number of parts, requiring a minimum of assembly, and which is capable of functioning in two polarizations.

Many variations to the above-identified embodiments are possible without departing from the scope and spirit of the invention. Possible variations have been presented throughout the foregoing discussion.

Combinations and subcombinations of the various embodiments described above will occur to those familiar with this field, without departing from the scope and spirit of the invention.

What is claimed is:

1. An integrated antenna feed for sending and receiving high frequency radio signals, comprising:

a first waveguide having a cavity with a cavity wall;

a second waveguide, having a cavity with a first wall and a second wall, said second waveguide being rotatable around an axis with respect to the cavity of the first waveguide;

a rotator disposed between said first waveguide and said second waveguide, said rotator having a first portion adjacent to the first waveguide and a second portion adjacent to the second waveguide; and each of said first portion and said second portion of the rotator having an opening through which radio signals can pass.

2. The antenna feed of claim 1, wherein said openings in said first and second portions of said rotator are substantially centered with respect to the cavity of said first waveguide.

3. The antenna feed of claim 2, wherein the width of the openings of said first and second portions of the rotator are the same, and wherein the height of the openings of said first and second portions of the rotator are the same.

4. The antenna feed of claim 3, wherein the opening of the first portion is rotated by a predetermined angle gamma with respect to the opening of the second portion.

5. The antenna feed of claim 4, wherein the thickness of each of said first and second portions is equal to half the thickness of the rotator.

6. The antenna feed of claim 4, wherein the angle gamma is approximately forty-five degrees.

7. The antenna feed of claim 1, wherein the second waveguide is rotatable from a first position to a second position respectively corresponding to a first and a second polarization of the antenna feed.

8. The antenna feed of claim 7, wherein the first polarization and the second polarization are orthogonal with respect to each other.

9. The antenna feed of claim 1, wherein:

said cavities of the first and second waveguides have a substantially rectangular cross-section, and the width of the first wall of said cavity of said second waveguide is different from the width of the second wall of said second cavity substantially perpendicular to said first wall of said second cavity.

10. The antenna feed of claim 9, wherein the width of the cavity of the second waveguide is the same as the width of the cavity of the first waveguide.

11. The antenna feed of claim 1, further comprising a first configuration corresponding to a first polarization of the antenna, wherein said first configuration comprises:

the second waveguide being disposed such that the first wall of the cavity of the second waveguide is aligned with the wall of the cavity of the first waveguide; and the rotator being disposed at a predetermined angle alpha with respect to the cavity of the first waveguide.

12. The antenna feed of claim 11, wherein said angle alpha is acute.

13. The antenna feed of claim 1, further comprising a second configuration corresponding to the second polarization of the antenna, wherein said second configuration comprises:

the second waveguide being disposed such that the second wall of the cavity of the second waveguide is aligned with the first wall of the cavity of the first waveguide; and the rotator being rotated by a predetermined angle beta with respect to the first waveguide.

14. The antenna feed of claim 13, wherein said angle beta is acute.

15. The antenna feed of claim 1, wherein:

said rotator is coupled to the second waveguide, and when the second waveguide is rotated to align the first cavity of the second waveguide to the cavity of the first waveguide, the rotator is at an angle alpha with respect to the cavity of the first waveguide.

16. The antenna feed of claim 15, wherein, when the second waveguide is rotated to align the second cavity of the second waveguide to the cavity of the first waveguide, the rotator is at an angle beta with respect to the cavity of the first waveguide.

17. The antenna feed of claim 1, wherein the surface of the first waveguide, the second waveguide, and the rotator is metallic.

18. The antenna feed of claim 1, wherein the openings of said first and second portions of the rotator have a rectangular cross section.

19. The antenna feed of claim 1, wherein a corner of the rectangular cross section of the openings is rounded.

20. The antenna feed of claim 1, wherein an edge of the openings of said first and second portions are rounded.

21. The antenna feed of claim 1, wherein said angle alpha is approximately negative twenty-two and one-half degrees.

22. The antenna feed of claim 1, wherein said angle alpha is approximately positive twenty-two and one-half degrees.

23. A method of changing the polarization of a radio signal passing through an antenna feed having a first and second waveguide and a rotator disposed therebetween, comprising:

changing the polarization of said signal by an angle gamma in said rotator, passing said signal across an interface between said first waveguide and said rotator; and passing said signal across another interface between said rotator and said second waveguide.

* * * * *